US012478174B2

(12) United States Patent
Beecher et al.

(10) Patent No.: US 12,478,174 B2
(45) Date of Patent: Nov. 25, 2025

(54) SUNSCREEN DISPENSING BRUSH AND METHODS OF USING SAME

(71) Applicant: Colorescience, Inc., Carlsbad, CA (US)

(72) Inventors: Michael Anthony Beecher, Doylestown, PA (US); Patricia McGill Boland, Houston, TX (US); Deborah Eileen Gregg Bouche, Houston, TX (US)

(73) Assignee: Colorescience, Inc., Carlsbad, CA (US)

( * ) Notice: Subject to any disclaimer, the term of this patent is extended or adjusted under 35 U.S.C. 154(b) by 0 days.

(21) Appl. No.: 18/612,863

(22) Filed: Mar. 21, 2024

(65) Prior Publication Data

US 2024/0306804 A1 Sep. 19, 2024

Related U.S. Application Data

(63) Continuation of application No. 17/000,976, filed on Aug. 24, 2020, now Pat. No. 11,957,238.
(Continued)

(51) Int. Cl.

| | |
|---|---|
| ***A46B 11/00*** | (2006.01) |
| ***A45D 33/02*** | (2006.01) |
| ***A46B 9/02*** | (2006.01) |

(52) U.S. Cl.
CPC ..... *A46B 11/0013* (2013.01); *A45D 33/02* (2013.01); *A46B 9/021* (2013.01);
(Continued)

(58) Field of Classification Search
CPC . A46B 9/021; A46B 11/0013; A46B 11/0062; A46B 11/0089; A46B 2200/046;
(Continued)

(56) References Cited

U.S. PATENT DOCUMENTS

| | | | |
|---|---|---|---|
| 779,936 | A | 1/1905 | Hodgen |
| 1,121,788 | A | 12/1914 | Bongiovanni |

(Continued)

OTHER PUBLICATIONS

Colorescience, Sunforgettable Total Protection Brush-On Shield SPC 50 publication, printed on Jun. 25, 2019 from https://www.colorescience.com/products/sunforgettable-total-protection-brush-on-sunscreen-shield-spf-50, 12 pages.

(Continued)

*Primary Examiner* — Charles P. Cheyney
(74) *Attorney, Agent, or Firm* — Knobbe, Martens, Olson & Bear, LLP

(57) ABSTRACT

Powder dispensing brushes configured to apply a powder to a skin surface of a user are provided. The dispensing brush system can provide an efficient and effective easy to dispense sunscreen to the face and body. The system can include a housing, a powder supply chamber having an interior space configured to hold a predetermined volume of the powder, a passageway in communication with the interior space of the powder supply chamber, a filter, a second chamber distal to the filter configured to collect a volume of powder after the powder has passed through the filter, a flow restrictor plate including orifices arranged in an annular pattern, the flow restrictor plate configured to receive powder from the volume of powder upon actuation by a user, and an outer brush including a plurality of bristles.

20 Claims, 9 Drawing Sheets

Related U.S. Application Data

(60) Provisional application No. 62/892,379, filed on Aug. 27, 2019.

(52) U.S. Cl.
CPC ..... *A46B 11/0062* (2013.01); *A46B 11/0089* (2013.01); *A46B 2200/1046* (2013.01)

(58) Field of Classification Search
CPC ..... A46B 2200/1046; A45D 33/02; B67D 7/0227; B67D 7/0238
USPC ..... 401/270, 281, 269, 205; 222/189.02
See application file for complete search history.

(56) References Cited

U.S. PATENT DOCUMENTS 1,175,705 A * 3/1916 Ciai ..... A46B 11/0013 401/281
1,889,446 A * 11/1932 Lysons ..... A46B 11/0013 401/207
2,590,413 A 3/1952 Jardines
2,867,828 A 1/1959 Trutneff
4,247,339 A * 1/1981 Bolton ..... A46B 11/0013 106/31.6
4,944,625 A * 7/1990 Futter ..... A46B 11/0072 401/184
5,443,321 A 8/1995 Dolan
6,935,802 B1 * 8/2005 Byun ..... A46B 17/04 401/187
11,957,238 B1 4/2024 Beecher et al.
2003/0138285 A1 7/2003 Petit
2006/0216104 A1 * 9/2006 Bouix ..... A46B 11/0041 401/270
2009/0041530 A1 2/2009 Deans et al.
2009/0180825 A1 * 7/2009 Chang ..... A46B 11/0013 401/129
2010/0288300 A1 * 11/2010 Byun ..... A45D 33/36 132/299
2013/0121752 A1 * 5/2013 Byun ..... A46B 7/023 401/269

OTHER PUBLICATIONS

Illustration of the Sunforgettable Total Protection Brush-On Shield SPC 50 product, which was sold in the U.S. prior to Aug. 27, 2019.

* cited by examiner

| Length of Restrictor Plate | Number of Orifices Restrictor Plate | Diameter of Orifices (Proximal End) | Diameter of Orifices (Distal End) | Brush Arrangement |
|---|---|---|---|---|
| 5 mm (0.20 in) | 6 | 1.5 mm (0.059 in) | 2.0 mm (0.079) | Annular Brush + Center Brush |
| 1.5 mm (0.059 in) | 6 | 1.5 mm (0.059 in) | 2.0 mm (0.079) | Annular Brush |
| 5 mm (0.20 in) | 6 | 1.5 mm (0.059 in) | 2.0 mm (0.079) | Annular Brush |
| 13 mm (0.51 in) | 4 | 1.32 mm (0.052 in) | 2.0 mm (0.079) | Annular Brush + Center Brush |
| 13 mm (0.51 in) | 8 | 1.1 mm (0.043 in) | 1.6 mm (0.063 in) | Annular Brush + Center Brush |
| 1.5 mm (0.059 in) | 8 | 1.1 mm (0.043 in) | 1.6 mm (0.063 in) | Annular Brush |

FIG. 10

SUNSCREEN DISPENSING BRUSH AND METHODS OF USING SAME

PRIORITY CLAIM AND INCORPORATION BY REFERENCE

The present application is a continuation is U.S. application Ser. No. 17/000,976, filed on Aug. 24, 2020, titled SUNSCREEN DISPENSING BRUSH AND METHODS OF USING SAME, which claims priority to U.S. Provisional Application No. 62/892,379, filed on Aug. 27, 2019, titled SUNSCREEN DISPENSING BRUSH AND METHODS OF USING SAME, the contents of both of which are hereby incorporated by reference herein in their entirety as if fully set forth herein. The benefit of priority is claimed under the appropriate legal basis including, without limitation, under 35 U.S.C. § 119(e). Any and all applications for which a foreign or domestic priority claim is identified in the Application Data Sheet as filed with the present application are hereby incorporated by reference herein in their entirety and made a part of this specification.

BACKGROUND OF THE DISCLOSURE

Field of the Disclosure

The disclosure relates to dispensing brushes, in particular, to brushes for dispensing cosmetic and/or UV blocking powders to one's skin.

BACKGROUND AND DESCRIPTION OF THE RELATED ART

Cosmetic and sunscreen powders, along with applicators, have been used in the past, including, for example, dispensing brush applicators such as Applicant's Sunforgettable® brush (registered trademark of Colorescience, Inc.).

SUMMARY

As the importance of a physical sunscreen increases in light of studies showing risks of chemical sunscreens to both the user and the environment, there remains a need for an applicator to provide consistent and even application of physical, powder sunscreens, particularly if those powders have a tendency to agglomerate and/or have enhanced skin adherence.

Accordingly, several embodiments described herein provide a powder dispensing brush having a powder chamber that can hold a volume of powder that can be caused to flow through a passageway and through a filter into a chamber (which can be configured for priming or dosing the brush and can be referred to as a priming chamber, a dosing chamber, or a priming/dosing chamber). The priming chamber can allow for a volume of the powder to be accumulated proximal to the flow restrictor plate to ensure a consistent flow of the powder through the flow restrictor plate. The flow restrictor plate can have a plurality of optimized orifices therein to control a flow of the powder to the brush that is distal to the flow restrictor plate.

Although the dispensers described herein are used to dispense sunscreen in many embodiments, other powders may also be dispensed including but not limited to foundation, color correctors, highlighters (such as check and brow highlighters), eye color, blush and other cosmetic and dermatological powders, each with or without a sun protection factor.

Certain medicated powders may also be advantageous for dispensing in the systems described herein, including dermatological anti-acne formulations (e.g., in powder or encapsulated form). Several embodiments are also useful to apply powders or other materials to the scalp (for example, sunscreen, hair color, dry shampoo, medicaments, etc.).

In several embodiments, the systems disclosed here have one, several or all of the following advantages: consistent application of a powder to the face or body, reduced streaking of the applied powder, reduced clogging in the consistent and even application of a sunscreen, reduced priming of the brush, and consistent flow through the powder dispensing brush.

In some embodiments, a powder dispensing brush device configured to apply a powder to a skin surface of a user is provided. The powder dispensing brush device can have a housing, a brush coupled with a distal end of the housing, a powder supply chamber having an interior space configured to hold a predetermined volume of the powder, a passageway in communication with the interior space of the powder supply chamber. A filter can be positioned in the passageway. The filter can be configured to prevent or substantially reduce the passage of a mass of powder greater than a predetermined size through the filter. The powder dispensing brush device can have a priming chamber distal to the filter, the priming chamber configured to collect a volume of powder after the powder has passed through the filter to enable a consistent flow of the powder through a flow restrictor plate adjacent to the priming chamber. In some embodiments, as described, the flow restrictor plate can be distal to the priming chamber. The flow restrictor plate can have a plurality of orifices that are in fluid communication with the interior space of the powder supply chamber. The powder dispensing brush device can also have an outer brush comprising a plurality of bristles extending in a distal direction from a distal end portion of the housing, wherein a proximal end of the bristles of the outer brush are arranged in an annular shape so as to form an interior cavity on an interior of the outer brush.

In some embodiments, a powder dispensing brush configured to apply a powder to a skin surface of a user, comprising a housing, a powder chamber having an interior space configured to hold a predetermined volume of the powder, a flow restrictor plate comprising a plurality of orifices that are in fluid communication with the interior space of the powder chamber, and an outer brush comprising a plurality of bristles extending in a distal direction from a distal end portion of the housing is provided.

In one embodiment, a method of applying a powder on one's skin using a dispensing device having a brush is provided, comprising loading a powder in a first chamber of the device, applying a force to the device to cause at least a portion of the powder to move through a plurality of orifices in a flow restrictor plate located between the first chamber and the brush so as to at least partially fill a cavity of space inside the brush with the powder, and moving the brush against one's skin to cause the powder to move through the brush and onto one's skin. In some embodiments, applying a force to the device to cause at least a portion of the powder to move through the plurality of orifices in the flow restrictor plate comprises orienting the dispensing device so that the brush of the dispensing device is pointing downward and moving the dispensing device in a downward direction against a surface of an object to exert a downward force on the powder that is in the first chamber, the downward force being greater than a gravitational force.

In several embodiments, the brush or method of using same, is designed for use for skin is on the face or neck, below the neck and/or on the scalp. In some embodiments, the powder is a cosmetic and/or skincare powder, is tinted, and/or has a sun protection factor (SPF) of at least 15, 30 or 50. The powder may have no tint. In several embodiments, the powder is a non-chemical, mineral powder that provides sun protection (e.g., both UVA and UVB protection) in one convenient, on-the-go application, alone or over makeup, and may be water-resistant. The devices described herein may be provided empty (e.g., without a powder or other material), or provided to an end-user with the powder pre-loaded in the device (e.g., in the powder supply chamber). In one embodiment, the device is refillable (e.g., the user may refill with additional powder or other material). In some embodiments, the powder comprises titanium dioxide, zinc oxide, one or more antioxidants and one or more hydrating compounds.

Any of the powder dispending brush system and method of use embodiments disclosed herein can optionally include one or more of the following features, components, or other details of any of the following embodiments, in any combination. In some embodiments, a proximal end of the bristles of the outer brush can be arranged in an annular shape so as to form an interior cavity on an interior of the outer brush. The interior cavity can optionally be formed distal to the flow restrictor plate so that powder that is advanced through the plurality of orifices can enter the interior cavity before advancing through the brush. In some embodiments, the brush can further comprise an inner brush comprising a plurality of bristles extending in the distal direction from a center of a distal end portion of the flow restrictor plate. The inner brush can extend through the inner cavity. In some embodiments, a length of each of the plurality of orifices in the flow restrictor plate can be from approximately 4 mm to approximately 6 mm, optionally approximately 5 mm. The plurality of orifices can consist of from 5 to 7 orifices, optionally 6 orifices. The orifices each have a diameter of approximately 1.5 mm, or a tapered shape from proximal to distal end of approximately 1.5 to approximately 2.0 mm. The powder can be, without limitation, a sunscreen powder. In one embodiment, the system includes a header tank/dosing chamber downstream of the filter which constantly feeds 6×1.5 mm dispensing channels and a dispensing channel with a 5 mm length.

Also disclosed herein are embodiments of powder dispensing brushes configured to apply a powder to a skin surface of a user that can have a housing, a powder supply chamber having an interior space configured to hold a predetermined volume of the powder, a passageway in communication with the interior space of the powder supply chamber, a filter positioned in the passageway, a second chamber distal to the filter, the second chamber configured to collect a volume of powder after the powder has passed through the filter, a flow restrictor plate including a plurality of orifices arranged in an annular pattern, the flow restrictor plate being positioned adjacent to the second chamber and configured to receive powder from the volume of powder within the second chamber upon actuation by a user, an outer brush including a plurality of bristles extending in a distal direction from a distal end portion of the housing, and an inner brush including a plurality of bristles extending in the distal direction from a center portion of a distal end portion of the flow restrictor plate. In some embodiments, the filter configured to prevent the passage of a masses of powder greater than a predetermined size through the filter.

Also disclosed herein are embodiments of powder dispensing brushes configured to apply a powder to a skin surface of a user that can have a housing, a powder supply chamber having an interior space configured to hold a predetermined volume of the powder, a second chamber configured to receive a volume of the powder from the powder supply chamber, a filter positioned between the powder supply chamber and the second chamber, the filter being sized and configured to prevent a passage of masses of powder greater than a predetermined size through the filter and into the second chamber and to permit a passage of masses of powder smaller than or equal to a predetermined size to pass through the filter and into the second chamber upon activation by a user, a flow restrictor plate including a plurality of orifices that are in fluid communication with an interior space of the second chamber, the flow restrictor plate being configured to receive the powder from the volume of the powder within the second chamber upon actuation by a user, and a plurality of bristles extending in a distal direction from a distal end portion of the housing.

Also disclosed herein are embodiments of powder dispensing brushes configured to apply a powder to a skin surface of a user, including a housing, a powder supply chamber having an interior space configured to hold a predetermined volume of the powder, a second chamber distal to the powder supply chamber, the second chamber configured to collect a volume of powder after the powder has passed out of the powder supply chamber, a flow restrictor plate including a plurality of orifices arranged in an annular pattern, the flow restrictor plate being positioned adjacent to the second chamber and configured to receive powder from the volume of powder within the second chamber upon actuation by a user, and an outer brush including a plurality of bristles extending in a distal direction from a distal end portion of the housing.

Also disclosed herein are embodiments of powder dispensing brushes configured to apply a powder to a skin surface of a user, including a housing, a brush coupled with a distal end of the housing, a powder supply chamber having an interior space configured to hold a predetermined volume of the powder, a passageway in communication with the interior space of the powder supply chamber, a filter positioned in the passageway, the filter configured to prevent the passage of a masses of powder greater than a predetermined size through the filter, a priming chamber adjacent to the filter, the priming chamber configured to collect a volume of powder after the powder has passed through the filter, a flow restrictor plate including a plurality of orifices that are in fluid communication with the interior space of the powder supply chamber, the flow restrictor plate being positioned adjacent to the priming/dosing chamber and configured to receive powder from the volume of powder within the priming/dosing chamber upon actuation by a user, and an outer brush including a plurality of bristles extending in a distal direction from a distal end portion of the housing. In some embodiments, a proximal end of the bristles of the outer brush can be arranged in an annular shape so as to form an interior cavity on an interior of the outer brush.

Any embodiments of the devices and methods disclosed herein can include, in additional embodiments, one or more of the following features, components, and/or details, in any combination with any of the other features, components, and/or details of any other embodiments disclosed herein: wherein a length of each of the plurality of orifices can be from approximately 4 mm to approximately 6 mm; wherein the flow restrictor plate can be positioned adjacent to a distal end of the second chamber; wherein a proximal end of the plurality of bristles can be arranged in an annular shape so as to form an interior cavity in an interior portion of the plurality of bristles; wherein the plurality of orifices of the flow restrictor plate are generally aligned with the interior cavity in the interior portion of the plurality of bristles so that masses of powder that pass through the plurality of orifices enter the interior cavity in the interior portion of the plurality of bristles; wherein the second chamber can be configured to act like a header tank/reservoir to provide a more consistent and even feed or flow of the powder to the flow restrictor plate; wherein the flow restrictor plate can be positioned adjacent to a distal end of the second chamber; further including a passageway extending from the powder supply chamber to the second chamber; wherein the filter can be positioned within the passageway; wherein the second chamber can be adjacent to the filter; wherein a proximal end of the plurality of bristles are arranged in an annular shape so as to form an interior cavity in an interior portion of the plurality of bristles; wherein the plurality of orifices of the flow restrictor plate are generally aligned with the interior cavity in the interior portion of the plurality of bristles so that masses of powder that pass through the plurality of orifices enter the interior cavity in the interior portion of the plurality of bristles; and/or further including a second plurality of bristles extending in the distal direction from a center portion of a distal end portion of the flow restrictor plate.

Any embodiments of the devices and methods disclosed herein can include, in additional embodiments, one or more of the following features, components, and/or details, in any combination with any of the other features, components, and/or details of any other embodiments disclosed herein: further including a second plurality of bristles extending in the distal direction from a center portion of a distal end portion of the flow restrictor plate, wherein the second plurality of bristles extend through the interior cavity; wherein the interior cavity can be distal to the flow restrictor plate so that powder that is advanced through the plurality of orifices enters the interior cavity before advancing through the brush; wherein a length of each of the plurality of orifices can be from approximately 4 mm to approximately 6 mm; wherein a length of each of the plurality of orifices in the flow restrictor plate can be approximately 5 mm; wherein the plurality of orifices in the flow restrictor plate consists of 6 orifices; wherein the plurality of orifices in the flow restrictor plate consists of from 5 to 7 orifices; wherein the plurality of orifices in the flow restrictor plate each have a diameter of approximately 1.5 mm; wherein the plurality of orifices in the flow restrictor plate each taper along a length of the orifices, from approximately 1.5 mm at a proximal end of the orifices to approximately 2.0 mm at a distal end of the orifices; wherein the powder supply chamber contains the powder, and the powder can be a skincare and/or cosmetic powder; wherein the powder supply chamber contains the powder, and wherein the powder can be tinted; wherein the powder supply chamber contains the powder, and wherein the powder has a sun protection factor (SPF) of at least 15; wherein the powder supply chamber contains the powder, and wherein the powder has a sun protection factor (SPF) of at least 30; wherein the powder supply chamber contains the powder, and wherein the powder has a sun protection factor (SPF) of at least 50; and/or wherein an actuation of the brush includes at least one of application of a force to the brush and shaking the brush back and forth in an axial direction of the brush.

Also disclosed herein are embodiments of methods of applying a powder on one's skin using a dispensing device having a brush, including moving at least a portion of a powder from a powder supply chamber through a filter that is located distal to the powder supply chamber and into a second chamber supported within the dispensing device distal to the filter, the second chamber configured to receive a volume of the powder that has passed through the filter; preventing a passage of masses of the powder greater than a predetermined size through the filter and into the second chamber; moving at least a portion of the powder that can be in the second chamber through a plurality of orifices in a flow restrictor plate located distal to the second chamber and into a brush distal to the flow restrictor plate; and moving the brush against one's skin to cause the powder to move through the brush and onto one's skin.

Also disclosed herein are embodiments of methods of applying a powder on one's skin using a dispensing device having a brush, including moving at least a portion of a powder from a powder supply chamber through at least one orifice of a membrane that can be distal to the powder supply chamber and into a second chamber supported within the dispensing device; moving at least a portion of the powder that is in the second chamber through at least one opening in a flow restrictor into a brush distal to the flow restrictor; and moving the brush against one's skin to cause the powder to move through the brush and onto one's skin.

Also disclosed herein are embodiments of methods of applying a powder on one's skin using a dispensing device having a brush, including moving at least a portion of a powder through a filter that can be located distal to a powder supply chamber and into a priming chamber supported within the dispensing device distal to the filter, the priming chamber configured to collect a volume of powder after the powder has passed through the filter, moving at least a portion of the powder that is in the priming chamber through a plurality of orifices in a flow restrictor plate located distal to the priming chamber and into a brush distal to the flow restrictor plate, wherein the plurality of orifices each have a length of approximately 5 mm, and moving the brush against one's skin to cause the powder to move through the brush and onto one's skin.

Any embodiments of the devices and methods disclosed herein can include, in additional embodiments, one or more of the following features, components, and/or details, in any combination with any of the other features, components, and/or details of any other embodiments disclosed herein: wherein the membrane can be a filter; further including preventing a passage of masses of the powder greater than a predetermined size into the second chamber; including moving at least a portion of the powder that is in the second chamber through a plurality of openings in the flow restrictor into the brush; wherein the plurality of orifices each have a length of approximately 5 mm; wherein the plurality of orifices each have a diameter that tapers from approximately 1.5 mm at a proximal end of the orifice to approximately 2.0 mm to a distal end of the orifice; wherein moving at least a portion of a powder from the powder supply chamber through the at least one orifice of the membrane that can be distal to the powder supply chamber and into a second chamber supported within the dispensing device includes at least one of orienting the dispensing device so that the brush of the dispensing device is pointing downward and moving the dispensing device in a downward direction against a surface of an object to exert a downward force on the powder that is in the dispensing device and shaking the dispensing device back and forth; wherein the skin can be on the face or neck; wherein the skin can be below the neck; wherein the skin can be on the scalp; wherein the powder can be a skincare powder; wherein the powder can be tinted; wherein the powder has a sun protection factor (SPF) of at least 15; wherein the powder has a sun protection factor (SPF) of at least 30; and/or wherein the powder has a sun protection factor (SPF) of at least 50. Brief Description of the Drawings The foregoing and other features of the present disclosure will become more fully apparent from the following description and appended claims, taken in conjunction with the accompanying drawings. The drawings provide additional specificity and detail to the disclosure. However, the drawings depict only several embodiments in accordance with the disclosure and are not to be considered limiting of the scope the disclosure. Certain embodiments of the present disclosure will now be described hereinafter, by way of example only, with reference to the accompanying drawings in which:

BRIEF DESCRIPTION OF THE DRAWINGS

FIG. 10 (showing Table 1) shows values and dimensions of various features of some dispensing brush applicator embodiments disclosed herein.

DETAILED DESCRIPTION

Figure 1:
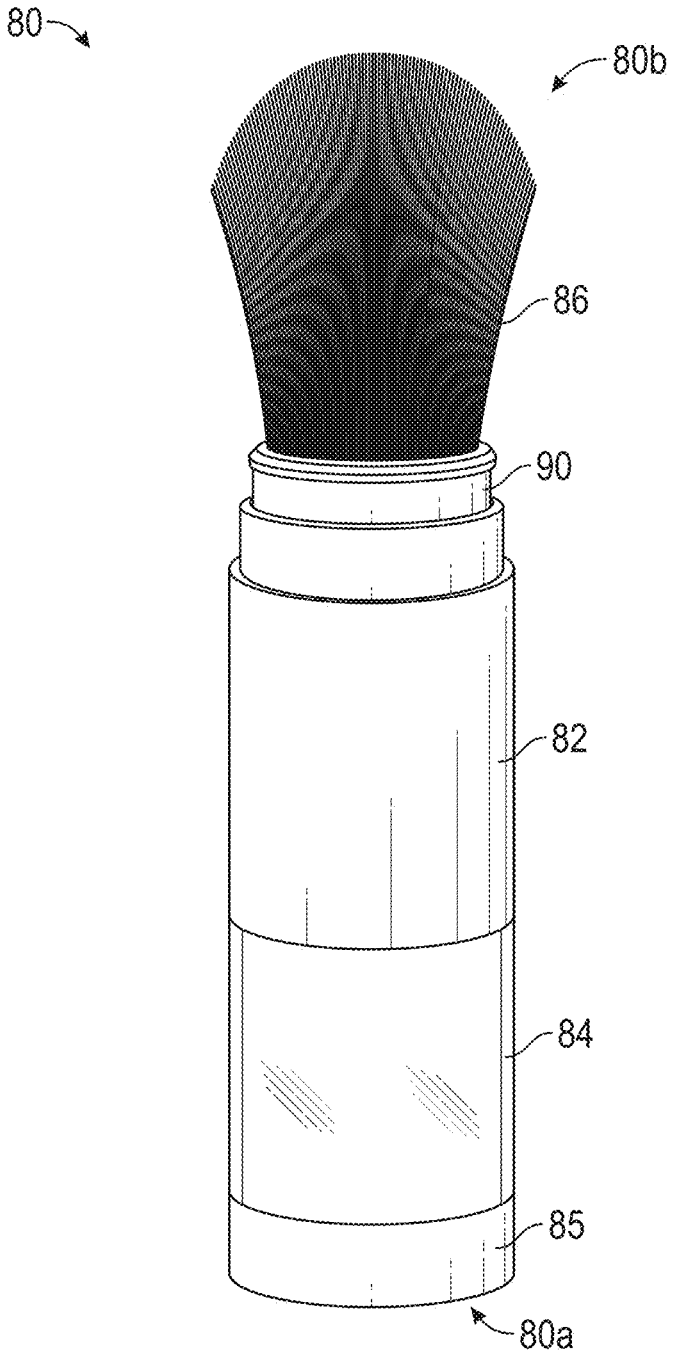
FIG. 1 is a perspective view of an embodiment of a powder dispensing brush applicator.

Sunscreen has become a critical part of protecting our skin from harmful and cancer causing ultraviolet rays that are radiated from the sun, which come in two forms—UVA and UVB rays. However, for many users, liquid or spray on sunscreens cannot be used with other cosmetics, particularly facial cosmetics. Powder sunscreens are preferred by many users because of the appearance, quality, and compatibility of such sunscreens.

Dispensing cosmetic and UV blocking powders with dispensing brush applicators presents many difficulties and challenges. First, it may be very difficult to achieve consistent dosing of the powder through the dispensing brush applicators to ensure a consistent application of the powder to the user's skin. Conventional applicators suffer from clogging and inconsistent dispensing, insufficient dispensing, excessive and/or wasteful dispensing, interruptions in flow, and other issues, particular with powders having enhanced adhesion properties.

Therefore, a need exists for an improved dispensing brush for the application for powder on the skin, including UV blocking powders cosmetics.

Embodiments of systems, components and methods of assembly and manufacture will now be described with reference to the accompanying figures, wherein like numerals refer to like or similar elements throughout. Although multiple embodiments, examples, and illustrations are disclosed herein, the embodiments described herein extend beyond the specifically disclosed embodiments, examples, and illustrations disclosed herein and can include other uses of the inventions and modifications and equivalents thereof, and combinations of any of the embodiments or the components, features, and/or details of any of the embodiments disclosed herein. Additionally, it should be noted that the descriptions of the embodiments disclosed herein should be interpreted to include any of the features, components, and other details of any of the other embodiments disclosed here in combination with or in the alternative to any of the features, components, and other details explicitly described herein. Therefore, any embodiments of the dispensing brushes (also referred to herein as, without limitation, a powder dispensing brush or dispensing brush applicator) or components thereof disclosed herein can have any of the features, components, and/or other details of any of the other dispensing brush embodiments or components thereof disclosed herein, including the dispensing brush embodiments and components thereof recited in the claims, to form additional embodiments having any combination of any of the features disclosed herein.

In several embodiments, the devices disclosed herein are directed to an improved powder dispensing brush device for delivering a powder to the skin of a user. Several embodiments of the brush devices disclosed herein provide a more consistent supply of powder through the brush than conventional or previously available dispensing brush devices, greatly improving the user experience with such devices.

In some embodiments, the improved powder dispensing brush device is configured to dispense a powder (optionally having sun blocking elements or capabilities) to the skin of the user. The powder, in several embodiments, has adhesion properties that allow the sunscreen to adhere better to the skin of the user, but also cause the powder to adhere to and clog conventional dispensing devices. Therefore, the dispensing device disclosed herein provides a better dispensing solution that is configured to dispense the powder effectively and consistently. In some embodiments, the dispensing brush devices described herein are particularly well-suited for powders that have improved adherence to the skin or a tendency to agglomerate inside the application device. Powders that offer hydration can lead to a certain powder consistency, which although beneficial for the skin, may be difficult to apply without the dispensing brushes described herein.

FIG. 1 shows a perspective view of an embodiment of a dispensing brush applicator 80 (also referred to herein as a powder dispensing brush). As shown in FIG. 1, any embodiments of the dispensing brush applicator 80 can have proximal end 80*a* and a distal end 80*b*, a housing 82, a powder chamber 84, and a brush 86, which can comprise a plurality of bristles (e.g., hair). The dispensing brush applicator 80 can optionally have an end cap 85 that is coupled with a proximal end portion 84*a* of the powder chamber 84.

Additionally, a removable cover (not shown in FIG. 1) can be selectively coupled with the housing 82 cover and/or conceal the brush 86.

A sleeve 90 can be selectively slidable in an axial direction to surround a side portion of the outer brush 86. The sleeve 90 can be moved or slid between a first or closed position wherein the sleeve 90 surrounds an outside surface of the outer brush 86 and a second or open position wherein the brush is not surrounded by or constrained by the sleeve 90. Optionally, in other embodiments, the sleeve 90 can be moved by actuation of a coupled actuation mechanism, such as a lever, spring, sliding tab, or otherwise.

FIGS. 2-6 illustrate another embodiment of an improved dispensing brush applicator 100 (also referred to herein as a powder dispensing brush). The embodiment of the dispensing brush applicator 100 shown in FIG. 2 can have any of the same features, components, dimensions, or other details of the embodiment of the dispensing brush applicator 80 shown in FIG. 1, in combination with any of the features, components, dimensions, or other details of the embodiment shown in FIGS. 2-6 and/or described herein.

As shown in FIGS. 2-6, any embodiments of the dispensing brush applicator 100 can have proximal end 100*a* and a distal end 100*b*, a housing 102, a powder chamber 104 (e.g., powder supply chamber 104), and an outer brush 106, which can comprise a plurality of bristles (e.g., hair). The dispensing brush applicator 100 can optionally have an end cap 105 that is coupled with a proximal end portion 104*a* of the powder chamber 104. Additionally, a removable cover 108 can be selectively coupled with the housing 102 cover and/or conceal the outer brush 106.

Figure 3:
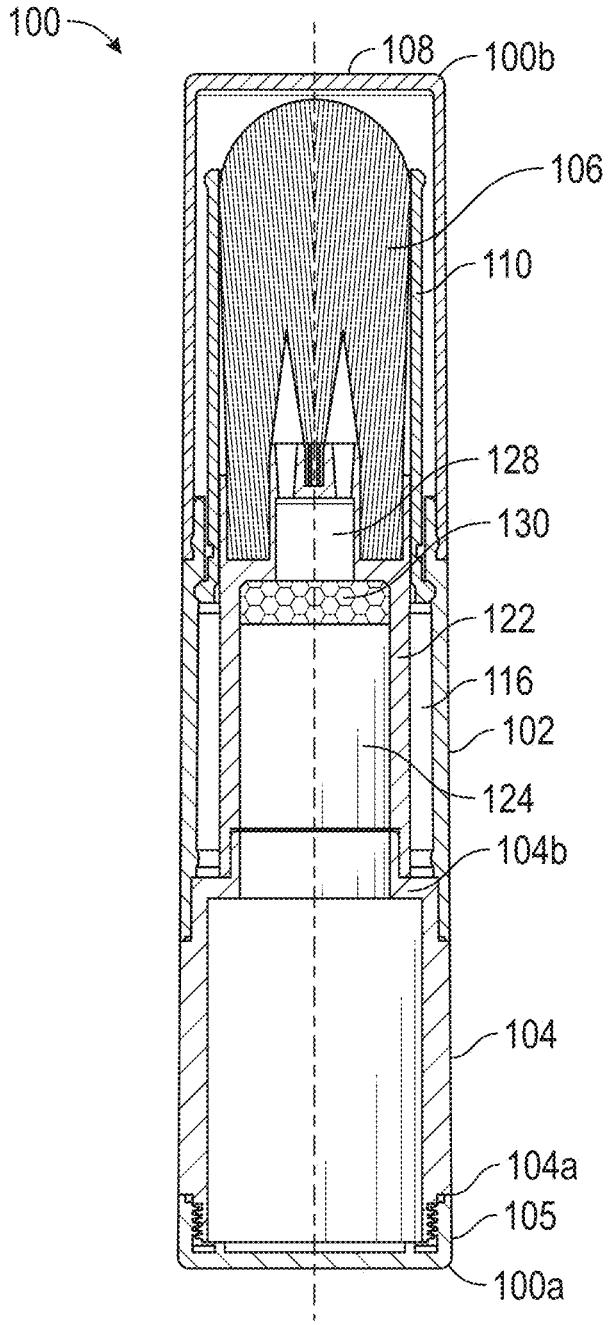
FIG. 3 is a section view through a middle portion of the embodiment of the dispensing brush applicator shown in FIG. 2, through line 3-3 in FIG. 2, wherein the brush applicator is in a closed state.
Figure 4:
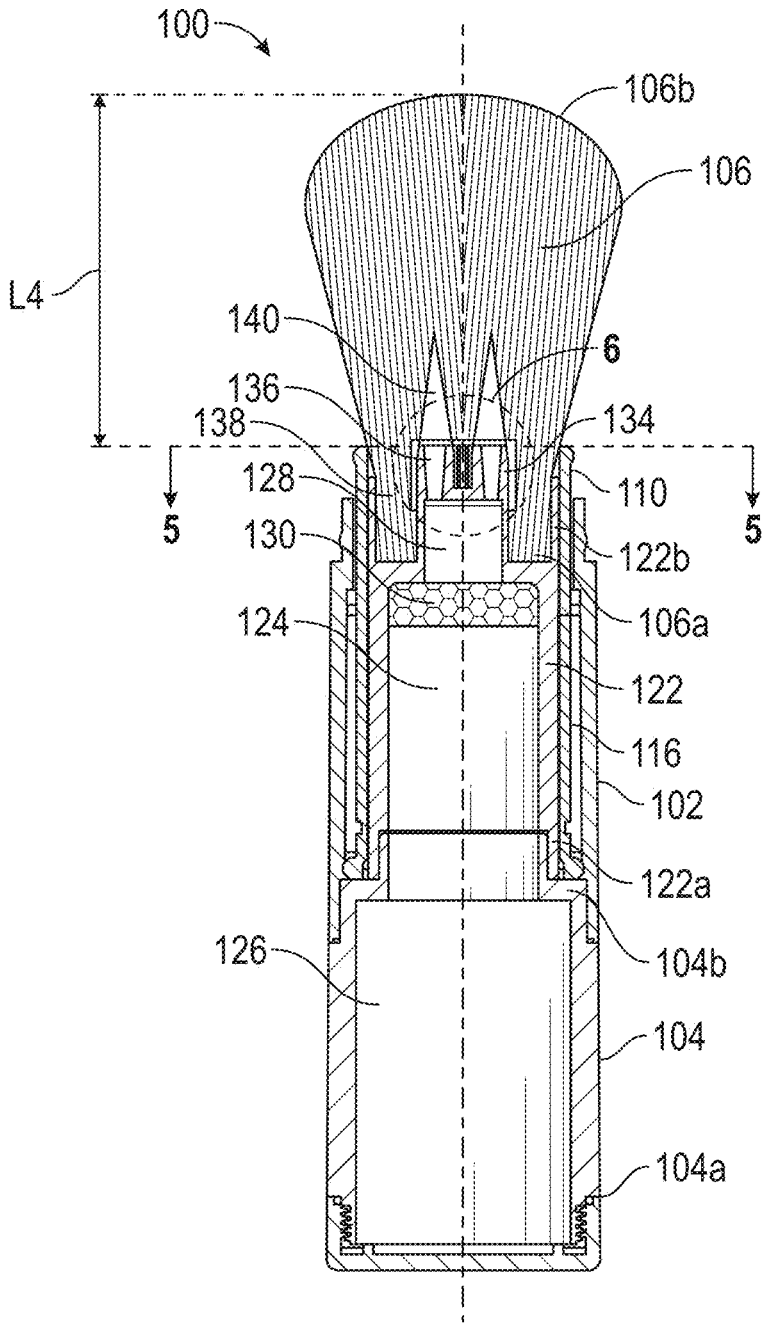
FIG. 4 is a section view through middle portion of the embodiment of the dispensing brush applicator shown in FIG. 1, such as through line 3-3 in FIG. 2, wherein the brush applicator is in a dispensing state or open state.
Figure 4A:
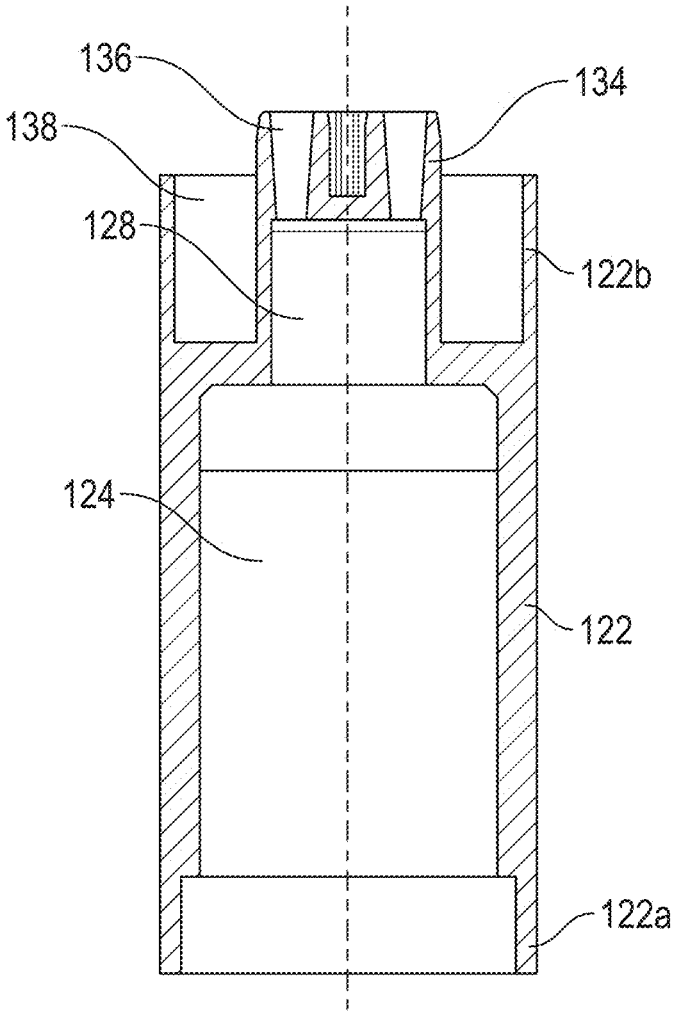
FIG. 4A is a section view of the restrictor body of the dispensing brush applicator shown in FIG. 2.
Figure 5:
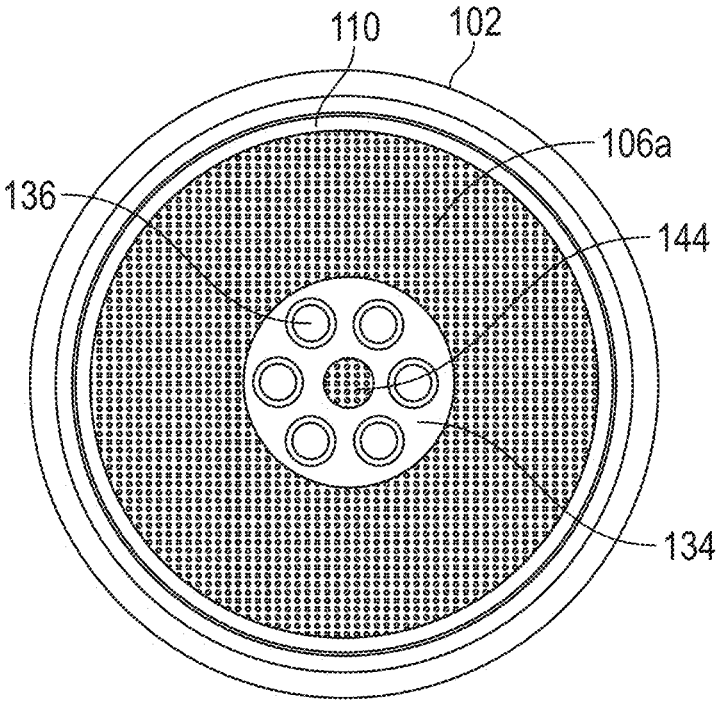
FIG. 5 is a section view through the dispensing brush applicator shown in FIG. 2, through line 5-5 in FIG. 2.
Figure 6:
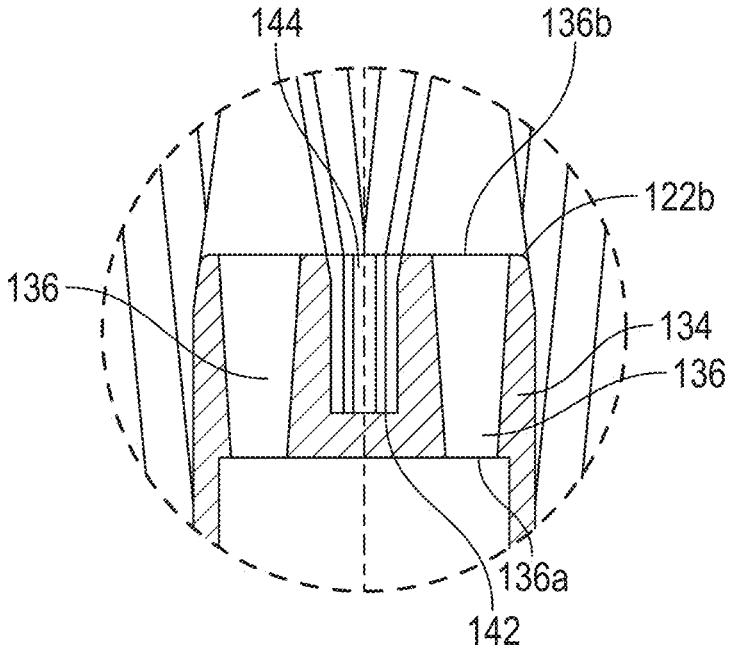
FIG. 6 is an enlarged detail view of a portion of the embodiment of the dispensing brush applicator shown in FIG. 2.

A sleeve 110 can be selectively slidable in an axial direction to surround a side portion of the outer brush 106. The sleeve 110 can be moved or slid between a first or closed position (as shown in FIG. 3) wherein the sleeve 110 surrounds an outside surface of the outer brush 106 and a second or open position (as shown in FIG. 4) wherein the brush is not surrounded by or constrained by the sleeve 110. Optionally, in other embodiments, the sleeve 110 can be moved by actuation of a coupled actuation mechanism, such as a lever, spring, sliding tab, or otherwise.

When the sleeve is in the open position, as shown in FIG. 4, the bristles of the outer brush 106 can open up or expand outwardly to create space or passageways between the bristles through which the powder from the chamber 104 can travel to be applied to a user's skin. When the sleeve 110 is moved toward the closed position, the sleeve can cause the bristles of the outer brush 106 to collapse inwardly to decrease the space or passageways between the bristles and thereby, prevent or reduce the amount of powder that can travel through the spaces and out past the end of the outer brush 106. In this state, the passageways through the outer brush 106 can effectively be terminated or closed to eliminate or reduce the amount of powder that can pass inadvertently through the outer brush 106.

In the second or open position, the sleeve 110 can optionally be positioned substantially or complete within a recess 116. The recess 116 can be formed between an inside surface of the housing 102 and an outside surface of a restrictor body 122. When the dispensing brush applicator is in an operable state, i.e., when the sleeve 110 is retracted or withdrawn into the recess 116, the bristles of the outer brush 106 will expand, as shown in FIG. 4 to provide the passageways described above for the powder to travel through the outer brush 106.

The restrictor body 122 can have a passageway 124 (e.g., interior chamber 124) that is in fluid communication with an interior space 126 (e.g., interior chamber 126) formed within the powder chamber 104. A proximal end 122*a* of the restrictor body 122 can be removably coupled with a distal end portion 104*b* of the powder chamber 104. The interior space 126 can optionally have a round cross-sectional shape and can have a diameter that is approximately 21 mm, or from approximately 18 mm to approximately 25 mm, or to or from any values within this range. The restrictor body 122 can also have a dosing chamber 128 (also referred to herein as a second chamber or a priming chamber, a header tank, or merely a chamber) distal to a filter 130 (also referred to herein as a filter membrane or a flow restrictor membrane) and passageway 124 of the restrictor body 122. In some embodiments, the dosing chamber 128 can act like a header tank to provide a more consistent and even feed or flow of powder to the flow restrictor plate 134. The dosing chamber 128 provides a significant improvement over prior art designs and can significantly improve the consistency of the flow of powder through the orifices and brush, particularly with powders having increased adhesive properties. In some embodiments, the dosing chamber 128 can have a smaller cross-sectional diameter as compared to a cross-sectional diameter of the passageway 124. For example and without limitation, some embodiments of the dosing chamber 128 can have a cross-sectional diameter that is approximately 20% smaller than the cross-sectional diameter of the passageway 124, or from approximately 10% smaller to approximately 50% smaller, or from approximately 20% smaller to approximately 30% smaller than the cross-sectional diameter of the passageway 124. The dosing chamber 128 can optionally have a circular cross-sectional shape or, in some embodiments, a square, hexagonal, or other polygonal or non-circular cross-sectional shape. In any embodiments, the dosing chamber 128 can have an inner diameter that is approximately 7.3 mm, or from approximately 5 mm to approximately 12 mm, or from approximately 7 mm to approximately 9 mm, or from and to any values within these ranges. In any embodiments, the dosing chamber 128 can have a length in the axial direction that is approximately 8 mm, or from approximately 5 mm to approximately 12 mm, or from approximately 7 mm to approximately 9 mm, or from and to any values within these ranges.

As mentioned, any embodiments of the dispensing brush applicator 100 can have an optional filter 130 in the flow passageway to further restrict a flow of powder through the dispensing brush applicator 100. In any embodiments disclosed herein, the filter 130 can optionally be positioned in a distal portion of the passageway 124. In some embodiments, as shown in FIG. 4, the filter 130 can be positioned adjacent to the dosing chamber 128, on a proximal side of the dosing chamber 128. The filter 130 can optionally be made from polyurethane or any other suitable material and can have flow passageways therethrough that can define a tortuous flow path through the membrane 130. The filter 130 can optionally be formed from a filter material. In some embodiments, the filter 130 can be made from a porous material such as a polyurethane foam or other polymer having a pore size of approximately 15 to approximately 25 pores per inch (optionally, 19 pores per inch) and a density of approximately 1.35 to approximately 1.55 lb/cubic foot.

In some embodiments, the filter 130 can provide the following functions and benefits. The filter 130 can prevent clumps or large pieces of coagulated powder over a predetermined size or diameter from flowing into the orifices. The filter 130 can break up the clumps and coagulations of powder before the clumps and coagulations advance into the orifices, where such large pieces of powder can clog the orifices. The filter 130 can also reduce the amount of powder that can flow through the passageway such as, but not limited to, when the distal end 100*b* is pointing in the downward direction. In other words, in some embodiments, the filter 130 can reduce the amount of power that can flow through the passageway through the dispensing brush applicator 100, optionally as a result of gravitational forces on the powder. The filter 130 can thereby, in some embodiments, reduce or eliminate inadvertent dispensing of powder through the brush 100, and/or reduce the flow rate through the passageway.

The dosing chamber 128 can provide a source or volume of powder adjacent to the flow restrictor plate 134, which can result in a more even flow of the powder through the flow restrictor plate 134 and the brush. Without the dosing chamber 128, the flow of powder through the flow restrictor plate 134 and, hence, the brush, can be inconsistent and inadequate because, in some embodiments, the filter 130 can restrict the flow through the passageway. In some embodiments, the dosing chamber 128 can be primed (e.g., supplied with powder) before application of the powder to the user's face by turning the applicator brush side down and repeatedly shaking the device or tapping the device against a firm surface. In some embodiments, the dosing chamber 128 can be primed by tilting the applicator so that the brush side is facing downward. The dosing chamber 128 can optionally have a circular cross-sectional shape or, in some embodiments, a square, hexagonal, or other polygonal cross-sectional shape. In any embodiments, the dosing chamber 128 can have an inner diameter that is approximately 8 mm, or from approximately 5 mm to approximately 12 mm, or from approximately 7 mm to approximately 9 mm, or from and to any values within these ranges.

In any embodiments, a diameter of the dosing chamber 128 can be approximately half of a diameter of the passageway 124, or from approximately 30% to approximately 70% of the diameter of the passageway 124, or from approximately 40% to approximately 60% of the diameter of the passageway 124, to reduce or attenuate a flow of powder through the restrictor body 122. In any embodiments, a cross-sectional area of the dosing chamber 128 can be approximately 25% of a cross-sectional area of the passageway 124, or from approximately 15% to approximately 40% of the cross-sectional area of the passageway 124, or from approximately 20% to approximately 30% of the cross-sectional area of the passageway 124, to reduce or attenuate a flow of powder through the restrictor body 122. In some embodiments, the dosing chamber 128 can reduce the flow through the passageway 124 of the restrictor body 122 by approximately 60%, or from approximately 40% to approximately 80%, or from approximately 50% to approximately 70%, or from and to any values within these ranges.

In any embodiments disclosed herein, the filter (such as, but not limited to, filter 130) can be approximately 4 mm in length (i.e., in the axial or flow direction), or from approximately 2 mm to approximately 6 mm long, or from approximately 3 mm to approximately 5 mm long, or from and to any values within these ranges. In some embodiments, the filter 130 can optionally be sized to fit completely within the dosing chamber 128 so as to completely fill the cross-sectional area of the flow constricting passageway. In some embodiments, the filter 130 can have an outer size or diameter that is slightly greater than the size or diameter of the dosing chamber 128 so that filter 130 forms an interference fit with the inside surface of the dosing chamber 128 so as to bias the filter 130 to remain stationary within the dosing chamber 128. Recesses, ledges, tabs, adhesive, or other suitable features can be used to bias or secure the filter 130 in the desired position within the dosing chamber 128. In any embodiments, the filter 130 can have an outer diameter in a relaxed state that is approximately 9 mm, or from approximately 6 mm to approximately 13 mm, or from approximately 8 mm to approximately 10 mm, or from and to any values within these ranges.

A distal portion 122*b* of the restrictor body 122 can have a flow restrictor plate 134 (also referred to herein as a restrictor plate or dosing platform) having a plurality of orifices 136 formed therethrough in the axial direction. The restrictor plate 134 can be integrally formed with the restrictor body 122 or, optionally, can be formed separately and coupled with or joined to the restrictor body 122. In any embodiments disclosed herein, the flow restrictor plate can have a length (i.e., in the axial direction) that is approximately 5 mm, or from approximately 2 mm to approximately 8 mm, or from approximately 3 mm to approximately 7 mm, or from approximately 4 mm to approximately 6 mm, or to and from any of the values within these ranges. The orifices can be configured to permit a consistent and predetermined flow of powder through the restrictor plate 134. Some embodiments of the dispensing brush applicator do not have a filter adjacent to the flow restrictor plate.

In any embodiments disclosed herein, one or more of the orifices 136 can have a tapered shape, wherein the cross-sectional area of the orifice either increases or decreases along the length of the orifice. In the illustrated embodiment, the orifices 136 are shown to have a tapering profile wherein the cross-sectional area increases linearly along a length of the orifice 136. For example and without limitation, one or more of the orifices can have a proximal end 136*a* having a proximal diameter or size that is less than a distal diameter or size at a distal end 136*b* of the orifice. Optionally, one or more of the orifices can have a distal diameter or size that is approximately 30% greater than the proximal diameter or size of the orifice, or from approximately 15% to approximately 45% greater than the proximal diameter or size of the orifice, or from approximately 25% to approximately 35% greater than the proximal diameter or size of the orifice, or from and to any values within these ranges.

For example and without limitation, in any embodiments disclosed herein, one or more of the orifices 136 can optionally have a proximal diameter of approximately 1.5 mm, or from approximately 1 mm to approximately 1.7 mm, or from approximately 1.1 mm to approximately 1.6 mm, or from approximately 1.3 mm to approximately 1.5 mm, or from and to any values within these ranges. One or more of the orifices 136 can optionally have a distal diameter of approximately 2 mm, or from approximately 1.5 mm to approximately 4 mm or from approximately 2 mm to approximately 3.5 mm, or from and to any values within these ranges. For example, the orifice can increase in diameter along a length of the orifice from by approximately 0.5 mm, or from approximately 0 mm to approximately 2.0 mm, or from approximately 0.25 mm to approximately 1.0 mm, or from and to any values within these ranges. Alternatively, in any embodiments, the orifice can have a consistent or uniform cross-sectional diameter or size along the length of the orifice 136.

In any embodiments disclosed herein, the restrictor plate can have 6 orifices, or from 3 to 9 orifices, or from 4 to 8 orifices, or from 5 to 7 orifices. In general, embodiments with a higher number of orifices can be configured to have orifices of a smaller size or diameter (which can be the proximal diameter or smallest diameter of the orifice) as compared to embodiments with a smaller number of orifices.

Table 1 (FIG. 10) shows examples of dispensing brush applicator embodiments and the features thereof. Any of the embodiments disclosed herein can have any combination of the features disclosed in Table 1, in addition to or in combination with any other features disclosed in Table 1 or otherwise herein to form new embodiments, all of which are contemplated as part of this disclosure.

The restrictor body 122 can also have a recess 138 formed in the distal end portion 122*b* of the restrictor body 122. The recess 138 can optionally have an annular shape and be configured to completely and continuously circumscribe the flow restrictor plate 134. The recess 138 can be configured to receive and couple with a proximal portion 106*a* of the outer brush 106 or the bristles thereof so that the outer brush 106 extends axially from the recess 138. The bristles of the proximal portion 106*a* of the outer brush 106 can be tightly or densely packed within the recess so that very little or a minimal amount of interstitial space exists between the bristles of the outer brush 106 and the proximal portion 106*a*. The bristles can be glued or otherwise adhered into the recess 138.

During manufacturing of any of the embodiments disclosed herein, following the assembly of the bristles in the recess 138 (or 238 in FIGS. 7 and 9) and the recess 142 formed in a center of the restrictor plate 134, the brush can be compared with a brush range chart that can show at least a minimum acceptable number of bristles and a maximum acceptable number of bristles. If the appearance of the bristles in the outer brush 106 and a second plurality of bristles 144 (e.g., inner brush 144 or center brush 144) is between the minimum acceptable number of bristles and a maximum acceptable number of bristles on the brush range chart, the brush can be passed to the next stage of manufacturing.

As mentioned, the brush can extend axially away from the recess 138 which can have an annular shape such that, when the outer brush 106 is in an open state, an interior space 140 can be formed distal to the restrictor plate 134 between the annular formation of the bristles of the outer brush 106. The space 140 can be approximately aligned with the plurality of orifices 136 extending through the restrictor plate 134 so that, after powder has advanced through the orifices 136, the powder can collect in the space 140 before working through the interstitial spaces in the outer brush 106.

Additionally, in any embodiments disclosed herein, the restrictor plate 134 can have a recess 142 formed in a center (i.e., along an axial centerline) of the restrictor plate 134. The second plurality of bristles 144 can extend from the recess 142 in the axial direction. The plurality of bristles (e.g., hairs) of the second plurality of bristles 144 can be the same as or similar to the bristles of the outer brush 106. Therefore, any embodiments of the dispensing brush applicator 100 disclosed herein can have a first, outer brush (such as outer brush 106) and a second, inner brush 144. The second plurality of bristles 144 can be configured to increase the number of bristles in the entire dispensing brush applicator 100 and/or can be configured to decrease the volume of the space 140 distal to the orifices 136 to limit the amount of powder that can collect or build up within the space 140.

The brush portion 106 in any embodiments disclosed herein can comprise a plurality of bristles. Bristles as used herein shall be given its ordinary meaning and shall include hair or other fibers that can be synthetic, natural, or a combination. Optionally, the bristles can comprise a white 100% waved Taklon material (which can have a shiny surface appearance or finish), polybutylene terephthalate, or any other natural, synthetic, or suitable material. The bristles are vegan and/or antimicrobial (e.g., antibacterial) in several embodiments. The bristles can be of the middle crimp type in several embodiments.

In some embodiments, the bristles can have a diameter of from approximately 0.04 mm (0.0016 in) to approximately 0.10 mm (0.0039 in), or from 0.05 mm (0.0020 in) to approximately 0.08 mm (0.0031 in), optionally, 0.07 mm (0.0028 in). In some embodiments, the bristles can have a length of from approximately 30 mm (1.18 in) to approximately 65 mm (2.56 in), or from approximately 35 mm (1.38 in) to approximately 60 mm (2.36 in), optionally, 36 mm (1.42 inch), or 55 mm (2.17 in). The bristles can be trimmed and shaped as desired, as shown in FIG. 1, for example and without limitation.

In some embodiments, for example and without limitation, each dispensing brush applicator 80 comprises approximately 5.55 grams of bristles, or from approximately 4 grams to approximately 7 grams, or from approximately 5 grams to approximately 6 grams of bristles.

Any of the components disclosed herein can be made from suitable materials. For example and without limitation, one or more of the components (such as the cap, housing, endcap, or other components) can optionally be made from a polymer material, such as but not limited ABS, PVC, nylon, or otherwise. Additionally, in any embodiments, the chamber and flow restrictor body can be made from styrene acrylonitrile or other suitable materials. The sleeve can optionally be made from ABS, styrene acrylonitrile, or a combination of the foregoing.

Figure 2:
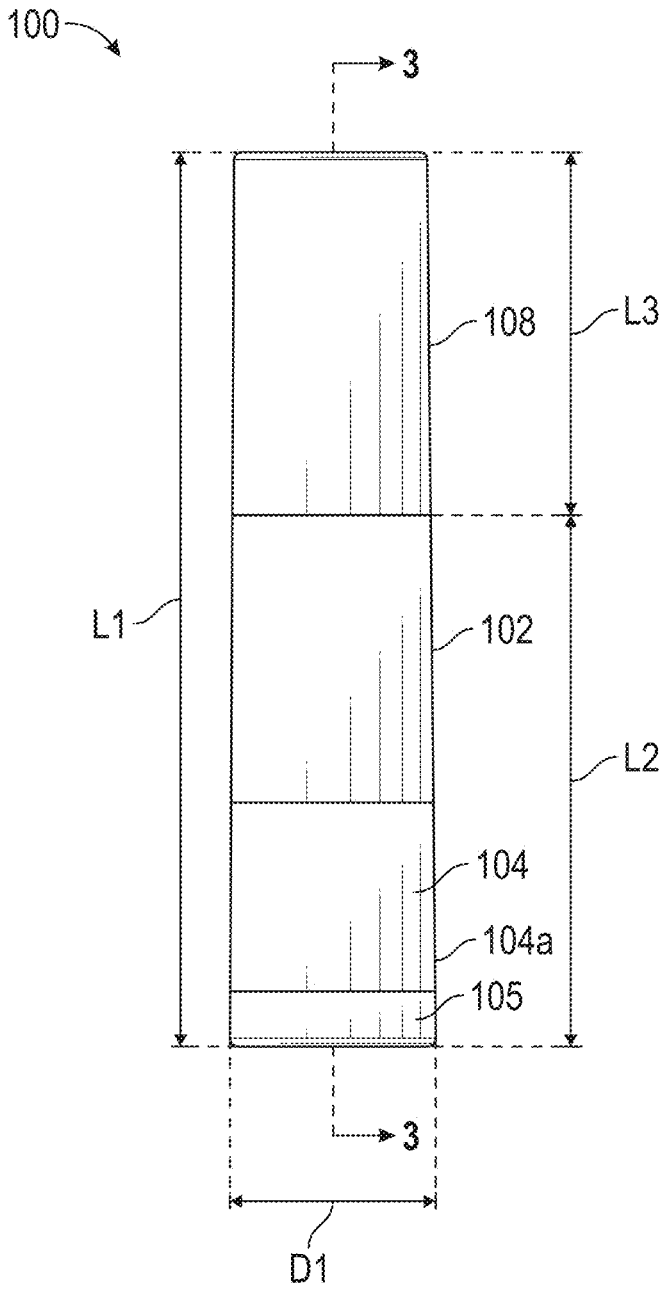
FIG. 2 is a side view of an embodiment of a dispensing brush applicator, showing the dispensing brush applicator with a cap covering the brush portion.
Figure 7:
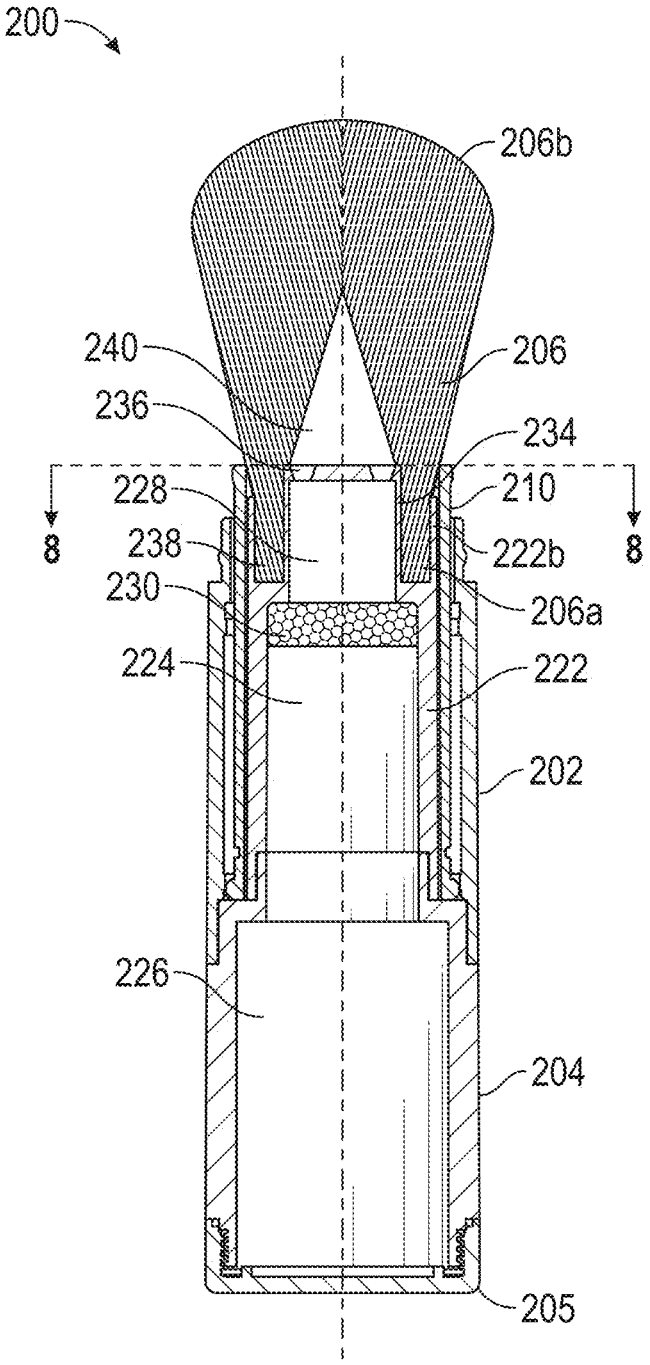
FIG. 7 is section view of another embodiment of a dispensing brush applicator through a middle of the applicator.
Figure 8:
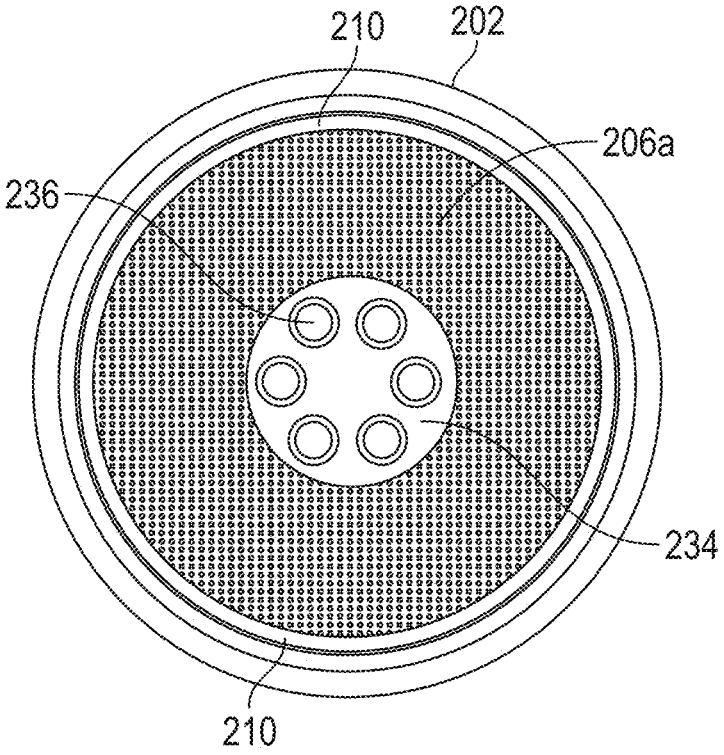
FIG. 8 is a section view through the dispensing brush applicator shown in FIG. 7, through line 8-8 in FIG. 7.
Figure 9:
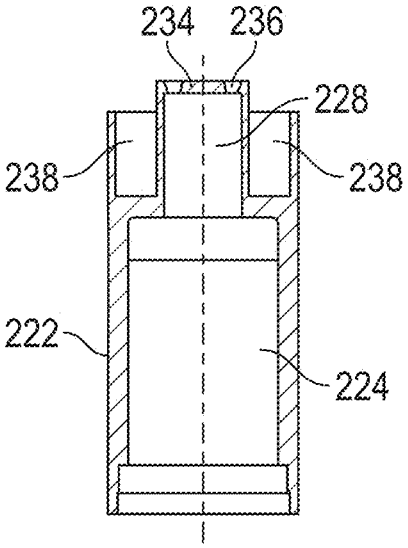
FIG. 9 is a section view of the restrictor body of the dispensing brush applicator shown in FIG. 7.

FIGS. 7-9 illustrate another embodiment of a dispensing brush applicator 200 that can have any of the same features, components, dimensions, or other details of any of the other embodiments of the dispensing brush applicators disclosed herein, including without limitation, dispensing brush applicator 100 shown in FIG. 2, in combination with any of the features, components, dimensions, or other details of the embodiment shown in FIG. 2 and/or described herein.

As shown in FIGS. 7-9, any embodiments of the dispensing brush applicator 200 can have proximal end 200*a* and a distal end 200*b*, a housing 202, a powder chamber 204, and an outer brush 206, which can comprise a plurality of bristles (e.g., hair). The dispensing brush applicator 200 can optionally have an end cap 205 that is coupled with the powder chamber 204. Additionally, a removable cover 208 can be selectively coupled with the housing 202 cover and/or conceal the outer brush 206.

As with the sleeve 110 above, a sleeve 210 can be selectively slidable in an axial direction to surround a side portion of the outer brush 206. When the sleeve is in the open position, as shown in FIG. 7, the bristles of the outer brush 206 can open up or expand outwardly to create space or passageways between the bristles through which the powder from the chamber 204 can travel to be applied to a user's skin. When the sleeve 210 is moved toward the closed position, the sleeve can cause the bristles of the outer brush 206 to collapse inwardly to decrease the space or passageways between the bristles and thereby, prevent or reduce the amount of powder that can travel through the spaces and out past the end of the outer brush 206. In this state, the passageways through the outer brush 206 can effectively be terminated or closed to eliminate or reduce the amount of powder that can pass inadvertently through the outer brush 206.

The restrictor body 222 can have a passageway 224 (also referred to herein as an interior chamber) that is in fluid communication with the interior chamber 226 formed within the powder chamber 204. The interior chamber 226 can optionally have a round cross-sectional shape and can have a diameter that is approximately 21 mm, or from approximately 28 mm to approximately 25 mm, or to or from any values within this range. The restrictor body 222 can also have a dosing chamber 228 (also referred to herein as a priming chamber, a header tank, or merely a chamber) distal to a filter 230 (also referred to herein as a filter membrane or a flow restrictor membrane) and the passageway 224 of the restrictor body 222. In some embodiments, the dosing chamber 228 can act like a header tank to provide a more consistent and even feed of powder to the flow restrictor plate 234. The dosing chamber 228 provides a significant improvement over prior art designs and can significantly improve the consistency of the flow of powder through the orifices and brush, particularly with powders having increased adhesive properties. In some embodiments, the dosing chamber 228 can have a smaller cross-sectional diameter as compared to a cross-sectional diameter of the passageway 224. For example and without limitation, some embodiments of the dosing chamber 228 can have a cross-sectional diameter that is approximately 20% smaller than the cross-sectional diameter of the passageway 224, or from approximately 10% smaller to approximately 50% smaller, or from approximately 20% smaller to approximately 30% smaller than the cross-sectional diameter of the passageway 224. The dosing chamber 228 can optionally have a circular cross-sectional shape or, in some embodiments, a square, hexagonal, or other polygonal or non-circular cross-sectional shape. In any embodiments, the dosing chamber 228 can have an inner diameter that is approximately 8 mm, or from approximately 5 mm to approximately 22 mm, or from approximately 7 mm to approximately 9 mm, or from and to any values within these ranges.

In any embodiments, a diameter of the flow constricting passageway 228 can be approximately 80% of a diameter of the passageway 224, or from approximately 60% to approximately 100% of the diameter of the passageway 224, or from approximately 70% to approximately 90% of the diameter of the passageway 224, to reduce or attenuate a flow of powder through the restrictor body 222. In any embodiments, a cross-sectional area of the flow constricting passageway 228 can be approximately 70% of a cross-sectional area of the passageway 224, or from approximately 50% to approximately 90% of the cross-sectional area of the passageway 224, or from approximately 60% to approximately 80% of the cross-sectional area of the passageway 224, to reduce or attenuate a flow of powder through the restrictor body 222. In some embodiments, the flow constricting passageway 228 can reduce the flow through the passageway 224 of the restrictor body 222 by approximately 75%, or from approximately 50% to approximately 90%, or from approximately 60% to approximately 80%, or from and to any values within these ranges Any embodiments of the dispensing brush applicator 200 can have an optional filter 230 in the flow passageway to further restrict a flow of powder through the dispensing brush applicator 200. The filter 230 can optionally be made from polyurethane or any other suitable material and can have flow passageways therethrough that can define a tortuous flow path through the membrane 230. The filter 230 can optionally be formed from a filter material, such as described above. The filter 230 can optionally be positioned in a distal portion of the flow constricting passageway 228. In some embodiments, the filter 230 can reduce the amount of powder that can flow through the passageway. In other words, in some embodiments, the filter 230 can reduce the amount of power that can flow through the passageway through the dispensing brush applicator 200. The filter 230 can thereby, in some embodiments, reduce or eliminate inadvertent dispensing of powder through the brush 200, and/or reduce the flow rate through the passageway.

In any embodiments disclosed herein, the filter (such as, but not limited to, filter 230) can be approximately 7 mm in length (i.e., In the axial or flow direction), or from approximately 5 mm to approximately 9 mm long, or from approximately 6 mm to approximately 8 mm long, or from and to any values within these ranges. The filter 230 can optionally be sized to fit completely within the flow constricting passageway 228 so as to completely fill the cross-sectional area of the flow constricting passageway.

A distal portion **222*b* of the restrictor body 222 can have a restrictor plate 234 having a plurality of orifices 236 formed therethrough in the axial direction. The restrictor plate 234 can be integrally formed with the restrictor body 222 or, optionally, can be formed separately and coupled with or joined to the restrictor body 222. In any embodiments disclosed herein, the flow restrictor plate can have a length (i.e., in the axial direction) that is approximately 1.5 mm, or from approximately 1 mm to approximately 4 mm, or from approximately 1 mm to approximately 2.5 mm, or from approximately 1 mm to approximately 2 mm, or to and from any of the values within these ranges. The orifices can be configured to permit a consistent and predetermined flow of powder through the restrictor plate 234**.

In any embodiments disclosed herein, one or more of the orifices 236 can have a tapered shape, wherein the cross-sectional area of the orifice either increases or decreases along the length of the orifice. In the illustrated embodiment, the orifices 236 are shown to have a tapering profile wherein the cross-sectional area increases linearly along a length of the orifice 236. For example and without limitation, one or more of the orifices can have a proximal end **236*a* having a proximal diameter or size that is less than a distal diameter or size at a distal end 236*b*** of the orifice. Optionally, one or more of the orifices can have a distal diameter or size that is approximately 30% greater than the proximal diameter or size of the orifice, or from approximately 25% to approximately 45% greater than the proximal diameter or size of the orifice, or from approximately 25% to approximately 35% greater than the proximal diameter or size of the orifice, or from and to any values within these ranges.

For example and without limitation, in any embodiments disclosed herein, one or more of the orifices 236 can optionally have a proximal diameter of approximately 1.5 mm, or from approximately 1 mm to approximately 1.7 mm, or from approximately 1.1 mm to approximately 1.6 mm, or from approximately 1.3 mm to approximately 1.5 mm, or from and to any values within these ranges. One or more of the orifices 236 can optionally have a distal diameter of approximately 2 mm, or from approximately 2 mm to approximately 4 mm or from approximately 2 mm to approximately 3.5 mm, or from and to any values within these ranges. For example, the orifice can increase in diameter along a length of the orifice from by approximately 0.5 mm, or from approximately 0 mm to approximately 2.0 mm, or from approximately 0.25 mm to approximately 2.0 mm, or from and to any values within these ranges. Alternatively, in any embodiments, the orifice can have a consistent or uniform cross-sectional diameter or size along the length of the orifice 236.

In any embodiments disclosed herein, the restrictor plate can have 6 orifices, or from 3 to 9 orifices, or from 4 to 8 orifices, or from 5 to 7 orifices. In general, embodiments with a higher number of orifices can be configured to have orifices of a smaller size or diameter (which can be the proximal diameter or smallest diameter of the orifice) as compared to embodiments with a smaller number of orifices. Table 1 shown in FIG. 10 shows examples of dispensing brush applicator embodiments and the features thereof. Any of the embodiments disclosed herein can have any combination of the features disclosed in Table 1, in addition to or in combination with any other features disclosed in Table 1 or otherwise herein to form new embodiments, all of which are contemplated as part of this disclosure. Ten, twelve, fifteen or more orifices are included in some embodiments (e.g., including but not limited to larger brush systems for dispensing powder to larger surface areas). In one embodiment, a larger brush device for the legs, the chest, the back etc. is provided in dimensions that are 1.5-3 times larger than the dimensions provided herein.

The restrictor body 222 can also have a recess 238 formed in the distal end portion 222*b* of the restrictor body 222. The recess 238 can optionally have an annular shape and be configured to completely and continuously circumscribe the flow restrictor plate 234. The recessed 238 can be configured to receive and couple with a proximal portion 206*a* of the outer brush 206 or the bristles thereof so that the outer brush 206 extends axially from the recess 238. The bristles of the proximal portion 206*a* of the outer brush 206 can be tightly or densely packed within the recess so that very little or a minimal amount of interstitial space exists between the bristles of the outer brush 206 and the proximal portion 206*a*. The bristles can be glued or otherwise adhered into the recess 238. As mentioned, the brush can extend axially away from the recess 238 which can have an annular shape such that, when the outer brush 206 is in an open state, an interior space 240 can be formed distal to the restrictor plate 234 between the annular formation of the bristles of the outer brush 206. The space 240 can be in fluid communication with the plurality of orifices 236 extending through the restrictor plate 234 so that, after powder has advanced through the orifices 236, the powder can collect in the space 240 before working through the interstitial spaces in the outer brush 206.

In any embodiments, without limitation the outside of the brush dispenser can have an overall length (indicated by L1 in FIG. 2), including the end cap 105 and cover 108, of from approximately 100 mm (3.94 in) to approximately 120 mm (4.72 in), for example, 113 mm (4.45 in). Additionally, the length of the body portion of the brush dispenser (indicated by L1 in FIG. 2), including the housing 102, powder chamber 104, and end cap 105 of from approximately 50 mm (1.97 in) to approximately 60 mm (2.36 in), for example, 55 mm (2.17 in). The end cap 105 can have a length (indicated by L3 in FIG. 2) of from approximately 40 mm (1.57 in) to approximately 50 mm (1.97 in), for example, 113 mm (1.81 in). The housing 102, powder chamber 104, end cap 105, and cover 108 can have an outside diameter (indicated by D3 in FIG. 2) of from approximately 20 mm (0.79 in) to approximately 30 mm (1.18 in), for example, 25.8 mm (1.02 in). In any embodiments, the brush 106 can have an unrestrained length (indicated by L4 in FIG. 4) of from approximately 28 mm (1.10 in) to approximately 38 mm (1.50 in), for example, 32.5 mm (1.28 in). In any other embodiments, the powder dispensing brush and any components thereof can have any desired sizes within these ranges or otherwise.

In some embodiments, smaller or larger improved dispensing brush applicators than depicted or described herein are provided. For example and without limitation, in some embodiments, one or more of the features or components of the improved dispensing brush applicator can have dimensions that are within 10%, or within 20%, or within 30% of any of the values described herein. In several embodiments, the dimensions of a larger applicator are approximately 25%-2× larger with respect to some or all of the dimensions provided herein. In some embodiments, the dimensions of a smaller applicator can be approximately 10-50% smaller. The bristle weight may be higher for larger applicators and lower for smaller applicators. For example, a mini-brush may be about 80-105 mm in total length (e.g., 90, 91, 92, 93, 95, 97, 99, 100 mm and ranges in between) with a bristle weight of about 5.5 grams (before trimming). In some embodiments, the brush or bristle portion of the mini-brush can have same details as any of the other brush embodiments disclosed herein. These smaller (or larger) applicators have, in many embodiments, the features described herein (such as, the restrictor plate, the dosing chamber, the plurality of orifices, etc.). In some embodiments, the size of one or more of the components can be smaller or larger, as described above, while one or more of the details regarding the plurality of orifices (such as the number, shape, and size of the orifices) or other details regarding the flow restrictor plate can be the same as in any other embodiments disclosed herein. For example and without limitation, an improved dispensing brush applicator can have an overall length of approximately 91, 92, 93, 94, or 95 mm and a diameter that is approximately 19, 20, 21, 22, or 23 mm, but have any of the features, dimensions, and/or other details shown in Table 1 shown in FIG. 10.

Kits comprising a powder dispensing brush together with another skincare product are also provided. In one embodiment, a kit with multiple powder dispensing brushes, each having a different shade or tint is provided. In another embodiment, a kit with instructions for use that instruct application every 2, 3 or 4 hours is provided. Kits including additional powder or powder refill components are provided in some embodiments.

Any embodiments disclosed herein can be used using the following steps and/or methods, in any desired order. Before each use, with the device in a vertical orientation, a user can tap the dispensing device against an object (which can be the user's hand, a table, or any other desired object) or can shake the device with a brush end or a cap end facing down. In some embodiments, the user can prepare the improved powder dispensing brush for use by optionally tapping the device a few or more times (for example, without limitation, 5-10 times) with the brush end facing downward, with or without the cap covering the bristles of the brush (though, preferably covering the bristles in several embodiments). The cap can be on the dispensing device so that the dispensing device is in a closed state when the device is being tapped or shaken. The force exerted on the powder in the chamber when the device is being tapped or shaken can cause the powder within the device to move toward the brush end of the dispensing device. The user can then remove the cap. The user can optionally flick or fan the bristles with his or her finger to visually observe whether the powder is flowing or to determine if there is powder in the brush head. The powder can then be dispensed from the device. The device can optionally be shaken or tapped at any time to cause additional powder to flow into the brush.

In several embodiments, the brush or method of using same, is designed for use on skin that is on the face or neck, below the neck and/or on the scalp. The back of the hands and the décolletage are particular areas that are vulnerable to the sun's damaging rays and the brush devices described herein offer a quick, efficient and effective way to protect those areas. In some embodiments, the powder is a cosmetic and/or skincare powder that has a sun protection factor (SPF) of at least 15, 30 or 50. The powder may or may not be tinted. In several embodiments, the powder is a non-chemical, all mineral powder that provides sun protection (e.g., both UVA and UVA protection), alone or over makeup, and may be water-resistant. For example, water-resistance may be up to 30, 50, 80, 120 minutes and longer. In some embodiments, the powder comprises titanium dioxide (between about 10-25%, e.g., approximately 10-25%, 22.5%, 25%, and overlapping ranges thereof) and/or zinc oxide (between about 10-25%, e.g., approximately 10-25%, 20-25 22.5%, 25%, and overlapping ranges thereof) and includes one, several or all of the following ingredients: hydroxyapatite, mica, dimethicone/vinyl dimethicone crosspolymer, dimethiconol/propylsilsequioxane/silicate crosspolymer, *Lycopodium clavatum* extract, sodium hyaluronate, imperata cyclindrica root extract, glycerin, water, *Caesalpinia spinosa* fruit pod extract, *Vitis vinifera* (grape) seed extract, *Camellia sinensis* leaf extract, *Quercus robur* (oak) wood extract, *Helianthus annuus* (sunflower) sprout extract, maltodextrin, methicone, triethoxycaprylylsilane, laureth-4, sodium benzoate, potassium sorbate, chromium oxide greens (CI77288), and iron oxides (CI 77491, CI77492, CI77499). Powders used herein may have hydration, skin adherence and/or agglomeration properties that are at least 10-25%, 25-50%, 50-100% or at least 2× higher than powders used in prior dispensing brushes.

The systems, methods and devices described herein have innovative aspects, no single one of which is indispensable or solely responsible for their desirable attributes. Any one embodiment disclosed herein may be combined with other suitable embodiments.

While certain embodiments of the inventions have been described, these arrangements have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. The accompanying claims and their equivalents are intended to cover such forms or modifications as would fall within the scope and spirit of the disclosure.

Features, materials, characteristics, or groups described in conjunction with a particular aspect, arrangement, or example are to be understood to be applicable to any other aspect, arrangement or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing arrangements. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a subcombination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some arrangements, the actual steps taken in the processes illustrated and/or disclosed may differ from those shown in the figures. Depending on the arrangement, certain of the steps described above may be removed, others may be added. Furthermore, the features and attributes of the specific arrangements disclosed above may be combined in different ways to form additional arrangements, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular arrangement. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain arrangements include, while other arrangements do not include, certain features, elements, and/or steps. Thus, such conditional language is not generally intended to imply that features, elements, and/or steps are in any way required for one or more arrangements or that one or more arrangements necessarily include logic for deciding, with or without user input or prompting, whether these features, elements, and/or steps are included or are to be performed in any particular arrangement.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain arrangements require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain arrangements, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred arrangements in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A powder dispensing brush configured to apply a powder to a skin surface of a user, comprising:

a housing;

a powder supply chamber having an interior space configured to hold the powder;

a second chamber comprising an open interior space configured to receive a portion of the powder from the powder supply chamber;

a plurality of orifices formed in a distal wall of the second chamber, such that the plurality of orifices are all in communication with the open interior space of the second chamber, the plurality of orifices being configured to receive at least some of the portion of the powder within the second chamber upon actuation by a user;

a plurality of bristles extending in a distal direction from a distal end portion of the housing;

a filter positioned between the plurality of orifices and the powder supply chamber, the filter being made from polyurethane and having flow passageways through the filter that each define a tortuous flow path through the filter; and wherein each of the plurality of orifices comprises a proximal end and a distal end, wherein each of the plurality of orifices is conical in shape along an entire length of each of the plurality of orifices such that the plurality of orifices increase in diameter along the entire length of the plurality of orifices extending between the proximal end and the distal end of each of the plurality of orifices.

2. The powder dispensing brush of claim 1, wherein a length of each of the plurality of orifices is from 4 mm to 6 mm.

3. The powder dispensing brush of claim 1, wherein the plurality of orifices are positioned adjacent to a distal end of the second chamber.

4. The powder dispensing brush of claim 1, wherein a proximal end of the plurality of bristles are arranged in an annular shape so as to form an interior cavity in an interior portion of the plurality of bristles.

5. The powder dispensing brush of claim 4, further comprising a second plurality of bristles extending in the distal direction from a center portion of a wall comprising the plurality of orifices so as to be between the plurality of orifices.

6. The powder dispensing brush of claim 4, wherein the plurality of orifices are generally aligned with the interior cavity in the interior portion of the plurality of bristles so that the powder that passes through the plurality of orifices enters the interior cavity in the interior portion of the plurality of bristles.

7. The powder dispensing brush of claim 1, wherein the filter is positioned adjacent to an opening of the second chamber, the filter being sized and configured to prevent a passage of masses of powder greater than a predetermined size through the filter and into the second chamber and to permit a passage of masses of powder smaller than or equal to the predetermined size to pass through the filter and into the second chamber upon activation by a user.

8. The powder dispensing brush of claim 1, further comprising a passageway extending from the powder supply chamber to the second chamber and a filter positioned within or adjacent to the passageway, the filter being sized and configured to prevent a passage of masses of powder greater than a predetermined size through the filter and into the second chamber and to permit a passage of masses of powder smaller than or equal to a predetermined size to pass through the filter and into the second chamber upon activation by a user.

9. The powder dispensing brush of claim 1, wherein the plurality of orifices in the plurality of orifices consists of from 5 to 7 orifices.

10. The powder dispensing brush of claim 1, wherein the plurality of orifices each taper along a length of the orifices from 1.5 mm at the proximal end of each of the orifices to 2.0 mm at the distal end of each of the orifices.

11. The powder dispensing brush of claim 1, wherein the powder supply chamber contains the powder and the powder is a skincare and/or a cosmetic powder.

12. The powder dispensing brush of claim 1, wherein an actuation of the powder dispensing brush comprises at least one of application of a force to the powder dispensing brush and shaking the powder dispensing brush back and forth in an axial direction of the powder dispensing brush.

13. A powder dispensing brush configured to apply a powder to a skin surface of a user, comprising:

a housing having a proximal end and a distal end;

a powder supply chamber coupled with the proximal end of the housing, the powder supply chamber having an interior space configured to hold a powder;

an interior chamber in the housing configured to receive therein a portion of the powder in the powder supply chamber;

a third chamber distal to the interior chamber, the third chamber configured to receive therein a portion of the powder in the powder supply chamber;

a plurality of orifices formed in and passing entirely through a wall positioned at a distal end of the third chamber so as to be in communication with the third chamber;

a filter positioned within the housing such that the powder must pass through the filter before passing through the plurality of orifices; and an outer brush comprising a plurality of bristles extending in a distal direction from a distal end portion of the housing;

wherein the plurality of orifices are positioned around a central portion of the end wall; and the plurality of orifices are configured to receive a portion of the powder that is in the third chamber upon actuation of the powder dispensing brush by a user.

14. The powder dispensing brush of claim 13, wherein the filter is positioned in the interior chamber at a distal end of the interior chamber.

15. The powder dispensing brush of claim 13, wherein the third chamber has an inner space and the interior chamber has an inner space, and wherein a volume of the inner space of the third chamber is less than half of a volume of the inner space of the interior chamber.

16. The powder dispensing brush of claim 13, wherein:

a length of each of the plurality of orifices is from approximately 4 mm to approximately 6 mm; and a proximal end of the plurality of bristles are arranged in an annular shape so as to form an interior cavity in an interior portion of the plurality of bristles.

17. The powder dispensing brush of claim 13, wherein the filter is made from polyurethane and has flow passageways through the filter that each define a tortuous flow path through the filter.

18. A powder dispensing brush configured to apply a powder to a skin surface of a user, comprising:

a housing;

a powder supply chamber having an interior space configured to hold the powder;

a second chamber configured to receive a portion of the powder from the powder supply chamber;

a plurality of orifices formed in a distal wall of the second chamber, the plurality of orifices being in communication with an interior space of the second chamber, the plurality of orifices being configured to receive at least some of the portion of the powder within the second chamber upon actuation by a user;

a passageway extending from the powder supply chamber to the second chamber;

a filter positioned within or adjacent to the passageway, the filter being sized and configured to prevent a passage of masses of powder greater than a predetermined size through the filter and into the second chamber and to permit a passage of masses of powder smaller than or equal to a predetermined size to pass through the filter and into the second chamber upon activation by a user; and a plurality of bristles extending in a distal direction from a distal end portion of the housing;

wherein:

each of the plurality of orifices comprises a proximal end and a distal end, wherein each of the plurality of orifices is conical in shape along an entire length of each of the plurality of orifices such that the plurality of orifices increase in diameter along the entire length of the plurality of orifices extending between the proximal end and the distal end of each of the plurality of orifices.

19. The powder dispensing brush of claim 13, wherein the plurality of orifices are rotatably fixed relative to the third chamber such that the plurality of orifices are in constant communication with the third chamber.

20. The powder dispensing brush of claim 18, wherein the plurality of orifices are positioned outside of a center portion of the distal wall of the second chamber.

* * * * *